US010976072B2

(12) United States Patent
Kuroki et al.

(10) Patent No.: US 10,976,072 B2
(45) Date of Patent: Apr. 13, 2021

(54) INDOOR UNIT OF AIR-CONDITIONING APPARATUS, AND AIR-CONDITIONING APPARATUS

(71) Applicant: Mitsubishi Electric Corporation, Tokyo (JP)

(72) Inventors: Shuichi Kuroki, Tokyo (JP); Shota Sugai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 21 days.

(21) Appl. No.: 16/477,548

(22) PCT Filed: Apr. 5, 2017

(86) PCT No.: PCT/JP2017/014245

§ 371 (c)(1),
(2) Date: Jul. 12, 2019

(87) PCT Pub. No.: WO2018/185882

PCT Pub. Date: Oct. 11, 2018

(65) Prior Publication Data

US 2020/0018517 A1 Jan. 16, 2020

(51) Int. Cl.
*F24F 13/20* (2006.01)
*F24F 13/32* (2006.01)
(Continued)

(52) U.S. Cl.
CPC ..... *F24F 13/20* (2013.01); *F24F 1/005* (2019.02); *F24F 1/32* (2013.01); *F24F 13/32* (2013.01)

(58) Field of Classification Search
CPC ..... F24F 13/20; F24F 13/32; F24F 1/0007; F24F 1/0057
See application file for complete search history.

(56) References Cited

U.S. PATENT DOCUMENTS 5,575,326 A * 11/1996 Asami ..... F24F 1/0057 165/124
6,189,328 B1 * 2/2001 Mochizuki ..... F24F 1/0007 62/298
(Continued)

FOREIGN PATENT DOCUMENTS

EP 2 527 758 A1 11/2012
JP S53-023163 U 2/1978
(Continued)

OTHER PUBLICATIONS

International Search Report of the International Searching Authority dated Jul. 4, 2017 for the corresponding international application No. PCT/JP2017/014245 (and English translation).

*Primary Examiner* — Nelson J Nieves
(74) *Attorney, Agent, or Firm* — Posz Law Group, PLC

(57) ABSTRACT

An indoor unit of an air-conditioning apparatus includes a base forming a rear surface and a part of a top surface of a main body and a design panel removably attached to at least one of a left side and a right side of the base to form a part of the top surface, a part of a lower surface, and a side surface of the main body. The base includes a first corner portion connecting a top surface and a side surface of the base and a lower surface and the side surface of the base and a step portion formed on at least one of the top surface and the lower surface of the base. The design panel includes a second corner portion connecting a top surface and a side surface of the design panel and a lower surface and the side surface of the design panel.

4 Claims, 7 Drawing Sheets

(51) Int. Cl.
*F24F 1/005* (2019.01)
*F24F 1/32* (2011.01)

(56) References Cited

U.S. PATENT DOCUMENTS 6,244,954 B1 * 6/2001 Hosokawa ..... F24F 1/0007 454/315
7,225,862 B2 * 6/2007 Chin ..... F28F 13/003 165/133
2006/0112710 A1 * 6/2006 Terada ..... F24F 13/222 62/285
2011/0113807 A1 * 5/2011 Kojima ..... F24F 1/0007 62/262
2012/0135674 A1 * 5/2012 Uehara ..... F24F 1/0011 454/338
2013/0102238 A1 * 4/2013 Zhang ..... F24F 1/0011 454/254
2015/0300678 A1 * 10/2015 Niimura ..... F24F 13/20 454/284
2015/0345809 A1 * 12/2015 Hayashi ..... F24F 1/0011 165/121
2017/0284682 A1 * 10/2017 Ugajin ..... F24F 1/0025
2018/0021468 A1 * 1/2018 Kim ..... F24F 13/28 250/436
2018/0023820 A1 * 1/2018 Kim ..... F24F 1/0007 250/435
2018/0224154 A1 * 8/2018 Taruki ..... B32B 5/022
2018/0347847 A1 * 12/2018 Taruki ..... F25D 21/14

FOREIGN PATENT DOCUMENTS

JP 58043333 A * 3/1983 ..... F24F 13/32
JP 61089424 A * 5/1986 ..... F24F 1/0047
JP H09-101046 A 4/1997
JP 11351608 A * 12/1999 ..... F24F 1/0007
JP 2006-073797 A 3/2006
JP 2010-169355 A 8/2010
JP 2011-064353 A 3/2011
JP 2011-149617 A 8/2011

* cited by examiner

INDOOR UNIT OF AIR-CONDITIONING APPARATUS, AND AIR-CONDITIONING APPARATUS

CROSS REFERENCE TO RELATED APPLICATION

This application is a U.S. national stage application of PCT/JP2017/014245 filed on Apr. 5, 2017, the contents of which are incorporated herein by reference.

TECHNICAL FIELD

The present invention relates to an indoor unit of an air-conditioning apparatus including a base forming a rear surface of a main body, and to an air-conditioning apparatus including the indoor unit.

BACKGROUND ART

A front panel of an indoor unit of an air-conditioning apparatus may be selected to suit the location at which the indoor unit is installed. As an example of such an indoor unit, an indoor unit of an air-conditioning apparatus has been proposed to which front panels of different designs are attachable without a change in the structure of the main body, to thereby make the indoor unit adaptable to various series designs (see Patent Literature 1, for example).

CITATION LIST

Patent Literature

Patent Literature 1: Japanese Unexamined Patent Application Publication No. 2010-169355

SUMMARY OF INVENTION

Technical Problem

The indoor unit of the air-conditioning apparatus described in Patent Literature 1 is only adaptable to changes in the front panel attached to a front surface of the main body, and is not adaptable to variations of the shape of the main body.

Therefore, there is room for improvement in design of the main body including side surfaces of the main body and variation of the shape of the main body.

The present invention has been made to address the issue as described above, and aims to provide an indoor unit of an air-conditioning apparatus and an air-conditioning apparatus improved in the design of the main body including the side surfaces thereof.

Solution to Problem

An indoor unit of an air-conditioning apparatus according to an embodiment of the present invention includes a base forming a rear surface and a part of a top surface of a main body and a design panel removably attached to at least one of a left side and a right side of the base to form a part of the top surface, a part of a lower surface, and a side surface of the main body. The base includes a first corner portion connecting a top surface and a side surface of the base and a lower surface and the side surface of the base and a step portion formed on at least one of the top surface and the lower surface of the base. The design panel includes a second corner portion connecting a top surface and a side surface of the design panel and a lower surface and the side surface of the design panel and a cutout portion formed in at least one of the top surface and the lower surface of the design panel. When the design panel is attached to the base, the step portion has a top surface portion exposed through the cutout portion, with the top surface portion and the design panel forming the top surface of the main body, and the design panel forms the side surface of the main body, with the second corner portion covering the first corner portion.

Advantageous Effects of Invention

According to the indoor unit of the air-conditioning apparatus according to the embodiment of the present invention, the side surface of the main body is formed of the single design panel, therefore improving the design.

DESCRIPTION OF EMBODIMENTS

Embodiment of this invention will be described below based on the drawings. In the following drawings including FIG. 1, the dimensional relationships between component members may be different from actual ones. Further, it is assumed in the following drawings including FIG. 1 that parts assigned with identical reference signs are identical or correspond to each other, which applies to the entire text of the specification. Further, the forms of component elements described throughout the text of the specification are basically illustrative, and the forms of component elements are not limited to these described ones.

Embodiment

Figure 1:
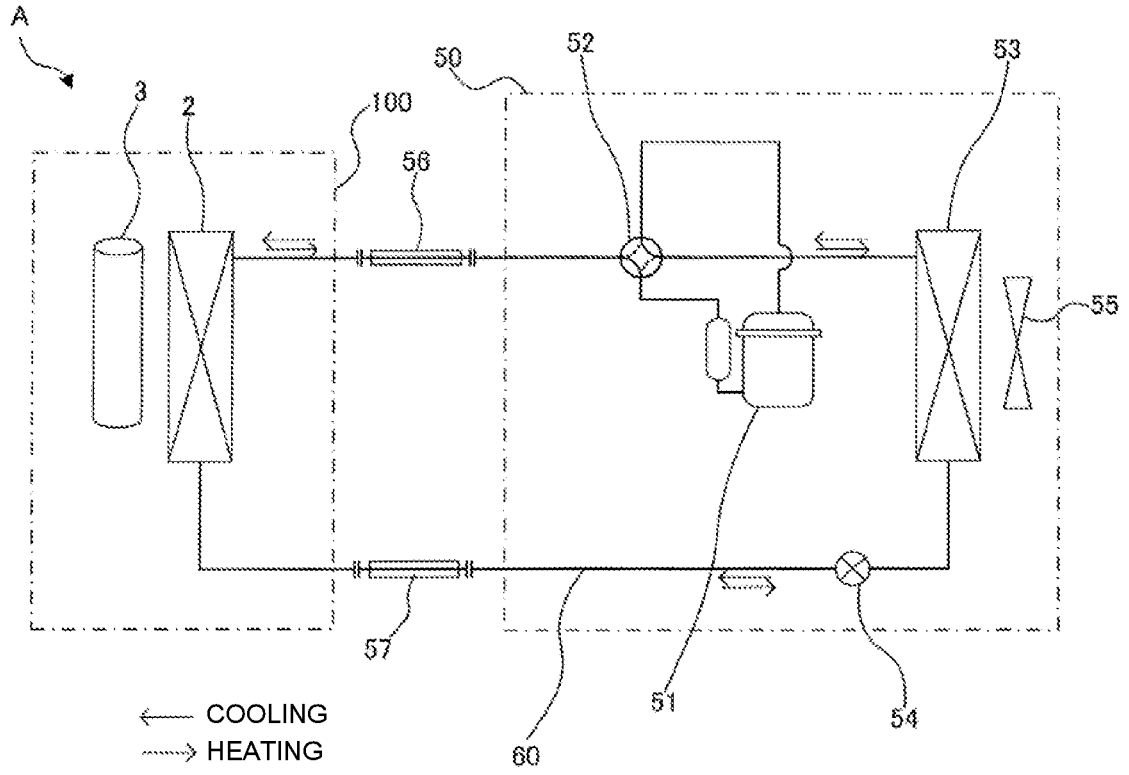
FIG. 1 is a schematic configuration diagram illustrating an example of the configuration of a refrigerant circuit of an air-conditioning apparatus according to Embodiment of the present invention.

FIG. 1 is a schematic configuration diagram illustrating an example of the configuration of a refrigerant circuit of an air-conditioning apparatus A according to Embodiment of the present invention. In FIG. 1, a flow of refrigerant during a cooling operation is indicated by solid-line arrows, and a flow of refrigerant during a heating operation is indicated by broken-line arrows.

<Configuration of Air-Conditioning Apparatus A>

As illustrated in FIG. 1, the air-conditioning apparatus A includes an indoor unit 100 and an outdoor unit 50.

The indoor unit 100 includes an indoor heat exchanger 2 and an indoor air-sending fan 3.

The outdoor unit 50 includes an outdoor heat exchanger 53, an outdoor air-sending device 55, a compressor 51, a four-way switching valve 52, and an expansion valve 54.

Further, the indoor unit 100 and the outdoor unit 50 are connected to each other by a gas-side communication pipe 56 and a liquid-side communication pipe 57, thereby forming a refrigerant circuit 60.

In the air-conditioning apparatus A, passages of the four-way switching valve 52 are switched to switch between the cooling operation and the heating operation. In the case of passages of the four-way switching valve 52 indicated by solid lines in FIG. 1, the air-conditioning apparatus A performs the cooling operation. Meanwhile, in the case of passages of the four-way switching valve 52 indicated by broken lines in FIG. 1, the air-conditioning apparatus A performs the heating operation.

(Indoor Unit 100)

The indoor unit 100 is installed in a space for supplying cooling energy or heating energy to an air-conditioned space (an air-conditioned space in a building, for example, or another space connected to the air-conditioned space via a duct), and has a function of cooling or heating the air-conditioned space with cooling energy or heating energy supplied by the outdoor unit 50.

The indoor heat exchanger 2 functions as a condenser in the heating operation, and functions as an evaporator in the cooling operation. The indoor heat exchanger 2 may be formed of a fin-and-tube heat exchanger, for example.

The indoor air-sending fan 3 is disposed to be surrounded by the indoor heat exchanger 2 to supply the indoor heat exchanger 2 with air, which is heat exchanging fluid.

(Outdoor Unit 50)

The outdoor unit 50 is installed in a space different from the air-conditioned space (outside of a building, for example), and has a function of supplying cooling energy or heating energy to the indoor unit 100.

The outdoor heat exchanger 53 functions as an evaporator in the heating operation, and functions as a condenser in the cooling operation.

The outdoor air-sending device 55 supplies the outdoor heat exchanger 53 with air, which is heat exchanging fluid. The outdoor air-sending device 55 may be formed of a propeller fan having a plurality of blades, for example.

The compressor 51 compresses and discharges the refrigerant. The compressor 51 may be formed of a compressor such as a rotary compressor or a scroll compressor, for example. When the outdoor heat exchanger 53 functions as a condenser, the refrigerant discharged from the compressor 51 passes through refrigerant pipes, and is sent to the outdoor heat exchanger 53. When the outdoor heat exchanger 53 functions as an evaporator, the refrigerant discharged from the compressor 51 passes through refrigerant pipes, routes through the indoor unit 100, and thereafter is sent to the outdoor heat exchanger 53.

The four-way switching valve 52 is provided on a discharge side of the compressor 51 to switch the refrigerant flow between the heating operation and the cooling operation. If the refrigerant is circulated unidirectionally, the four-way switching valve 52 is not an essential component. Further, a combination of two-way valves or three-way valves may be used as a substitute for the four-way switching valve 52.

The expansion valve 54 expands the refrigerant having passed through the indoor heat exchanger 2 or the outdoor heat exchanger 53 to reduce the pressure of the refrigerant. The expansion valve 54 may preferably be formed of an electrically driven expansion valve capable of adjusting the flow rate of the refrigerant, for example. The expansion valve 54 may be disposed not in the outdoor unit 50 but in the indoor unit 100.

In the air-conditioning apparatus A, the compressor 51, the indoor heat exchanger 2, the expansion valve 54, and the outdoor heat exchanger 53 are connected by refrigerant pipes including the gas-side communication pipe 56 and the liquid-side communication pipe 57 to form the refrigerant circuit 60.

<Operations of Air-Conditioning Apparatus A>

Operations of the air-conditioning apparatus A will now be described together with flows of the refrigerant. The cooling operation executed by the air-conditioning apparatus A will first be described. The flow of the refrigerant during the cooling operation is indicated by the solid-line arrows in FIG. 1. Herein, the operation of the air-conditioning apparatus A will be described with an example in which heat exchanging fluid is air and heat exchanged fluid is the refrigerant.

With the compressor 51 being driven, high-temperature, high-pressure, gas-state refrigerant is discharged from the compressor 51. Thereafter, the refrigerant flows along the solid-line arrows. The high-temperature, high-pressure gas refrigerant (single phase) discharged from the compressor 51 flows into the outdoor heat exchanger 53, which functions as a condenser, via the four-way switching valve 52. In the outdoor heat exchanger 53, the high-temperature, high-pressure gas refrigerant flowing therein and the air supplied by the outdoor air-sending device 55 exchange heat, and the high-temperature, high-pressure gas refrigerant is condensed into high-pressure liquid refrigerant (single phase).

The high-pressure liquid refrigerant sent from the outdoor heat exchanger 53 is turned into low-pressure, two-phase refrigerant containing gas refrigerant and liquid refrigerant by the expansion valve 54. The two-phase refrigerant flows into the indoor heat exchanger 2, which functions as an evaporator. In the indoor heat exchanger 2, the two-phase refrigerant flowing therein and the air supplied by the indoor air-sending fan 3 exchange heat. Thereby, the liquid refrigerant in the two-phase refrigerant evaporates, and the two-phase refrigerant turns into low-pressure gas refrigerant (single phase). With this heat exchange, the interior of a room is cooled. The low-pressure gas refrigerant sent from the indoor heat exchanger 2 flows into the compressor 51 via the four-way switching valve 52, and is compressed into high-temperature, high-pressure gas refrigerant and discharged again from the compressor 51. Thereafter, this cycle is repeated.

The heating operation executed by the air-conditioning apparatus A will now be described. The flow of the refrigerant during the heating operation is indicated by the broken-line arrows in FIG. 1.

With the compressor 51 being driven, high-temperature, high-pressure, gas-state refrigerant is discharged from the compressor 51. Thereafter, the refrigerant flows along the broken-line arrows. The high-temperature, high-pressure gas refrigerant (single phase) discharged from the compressor 51 flows into the indoor heat exchanger 2, which functions as a condenser, via the four-way switching valve 52. In the indoor heat exchanger 2, the high-temperature, high-pressure gas refrigerant flowing therein and the air supplied by the indoor air-sending fan 3 exchange heat, and the high-temperature, high-pressure gas refrigerant is condensed into high-pressure liquid refrigerant (single phase). With this heat exchange, the interior of the room is heated.

The high-pressure liquid refrigerant sent from the indoor heat exchanger 2 is turned into low-pressure, two-phase refrigerant containing gas refrigerant and liquid refrigerant by the expansion valve 54. The two-phase refrigerant flows into the outdoor heat exchanger 53, which functions as an evaporator. In the outdoor heat exchanger 53, the two-phase refrigerant flowing therein and the air supplied by the outdoor air-sending device 55 exchange heat. Thereby, the liquid refrigerant in the two-phase refrigerant evaporates, and the two-phase refrigerant turns into low-pressure gas refrigerant (single phase). The low-pressure gas refrigerant sent from the outdoor heat exchanger 53 flows into the compressor 51 via the four-way switching valve 52, and is compressed into high-temperature, high-pressure gas refrigerant and discharged again from the compressor 51. Thereafter, this cycle is repeated.

<Details of Indoor Unit According to Embodiment of Present Invention>

Figure 2:
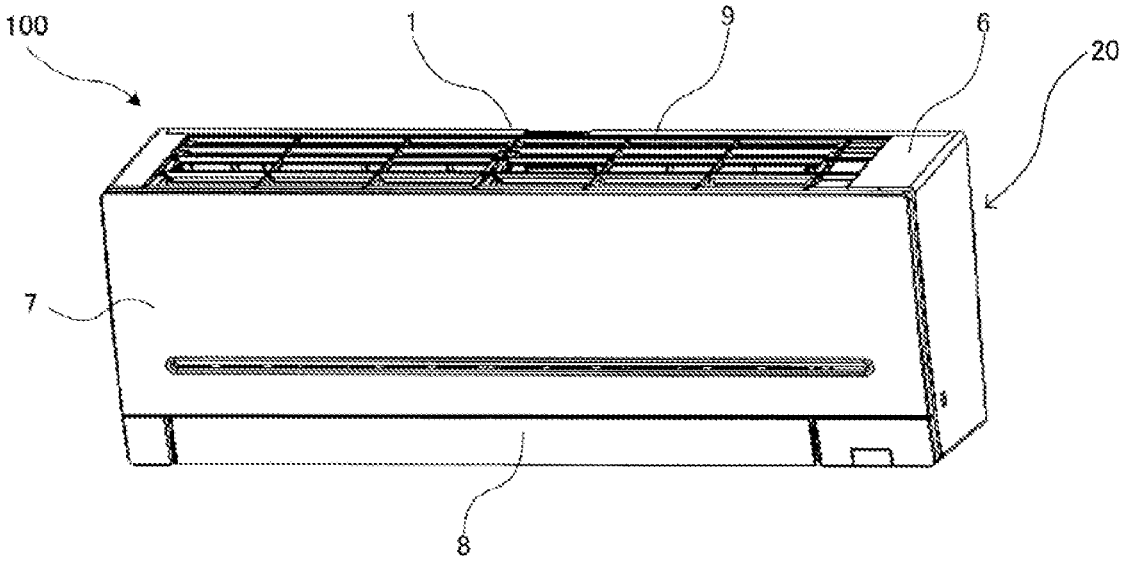
FIG. 2 is a perspective view schematically illustrating an example of the overall configuration of an indoor unit of the air-conditioning apparatus according to Embodiment of the present invention.
Figure 3:
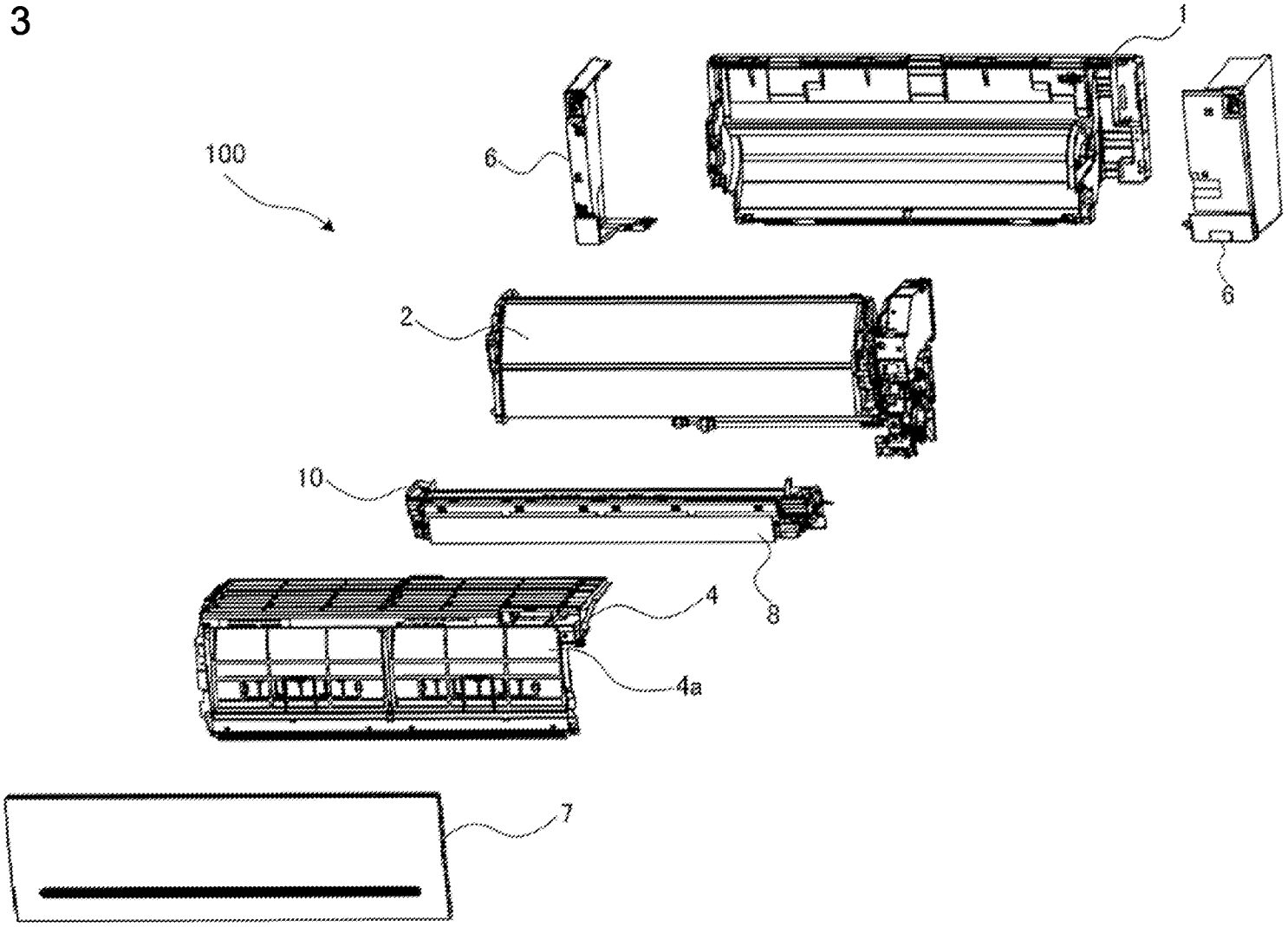
FIG. 3 is an exploded perspective view schematically illustrating a state in which the indoor unit of the air-conditioning apparatus according to Embodiment of the present invention is disassembled.
Figure 4:
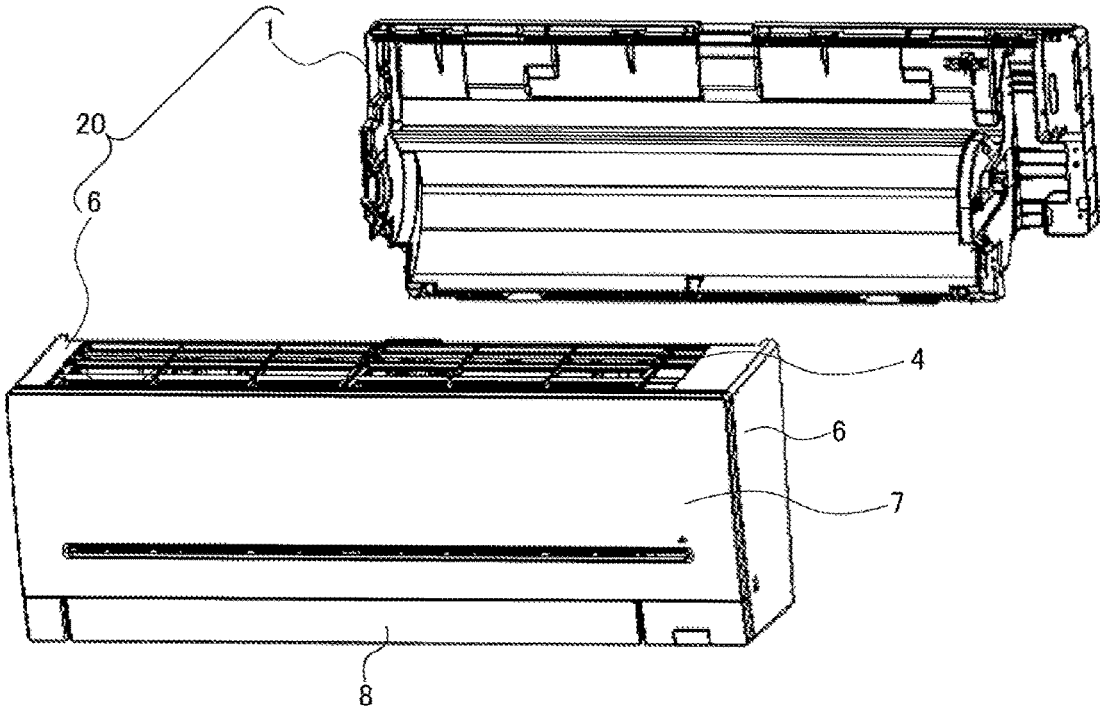
FIG. 4 is an exploded perspective view schematically illustrating a state in which the indoor unit of the air-conditioning apparatus according to Embodiment of the present invention is disassembled into a front surface side part and a rear surface side part.
Figure 5:
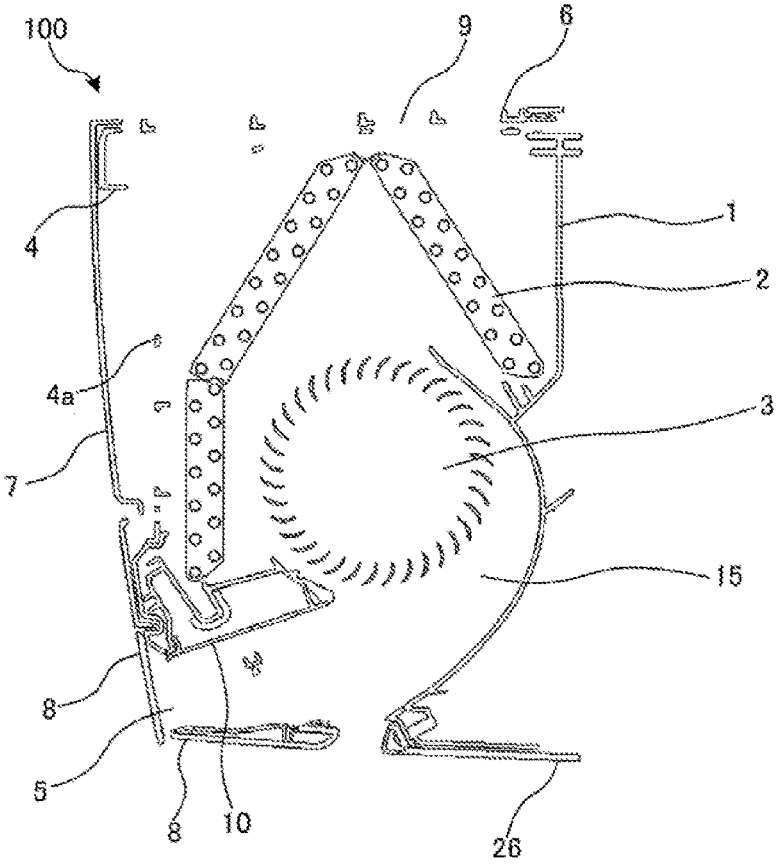
FIG. 5 is a side view schematically illustrating an internal configuration of the indoor unit of the air-conditioning apparatus according to Embodiment of the present invention, as viewed from a side surface of the indoor unit.

The indoor unit 100 according to Embodiment of the present invention will now be described in detail. FIG. 2 is a perspective view schematically illustrating an example of the overall configuration of the indoor unit 100. FIG. 3 is an exploded perspective view schematically illustrating a state in which the indoor unit 100 is disassembled. FIG. 4 is an exploded perspective view schematically illustrating a state in which the indoor unit 100 is disassembled into a front surface side part and a rear surface side part. FIG. 5 is a side view schematically illustrating an internal configuration of the indoor unit 100, as viewed from a side surface of the indoor unit 100. The indoor unit 100 will be specifically described based on FIGS. 1 to 5.

(Configuration of Indoor Unit 100)

The indoor unit 100 is installed in, for example, a living room forming the air-conditioned space. The living room normally has a space surrounded by a ceiling and wall surfaces. Further, the indoor unit 100 is installed with a rear surface thereof fixed to one of the wall surfaces and a top surface thereof set in the vicinity of the ceiling.

The following description will be given on the assumption that a surface of the indoor unit 100 on the wall surface side is a rear surface, a surface of the indoor unit 100 opposite to the rear surface is a front surface, a surface of the indoor unit 100 on the ceiling side is a top surface, a surface of the indoor unit 100 opposite to the top surface is a lower surface, a side surface of the indoor unit 100 on the right side in FIG. 2 is a right side surface, and a surface of the indoor unit 100 opposite to the right side surface is a left side surface. Further, components in the indoor unit 100 will also be described based on similar positional relationships.

As illustrated in FIG. 2, the indoor unit 100 includes a main body 20 formed into the shape of a horizontally long rectangular parallelepiped. The shape of the main body 20, however, is not limited to the shape of a horizontally long rectangular parallelepiped.

As illustrated in FIG. 3, the indoor unit 100 is disassemblable into a base 1, design panels 6, the indoor heat exchanger 2, a drain pan 10, a filter unit 4, and a front panel 7.

Further, as illustrated in FIG. 4, the main body 20 is formed into the shape of a rectangular parallelepiped having an internal space with a combination of the base 1 forming a rear surface and a part of a top surface of the main body 20, the design panels 6 forming parts of the top surface, parts of a lower surface, and left and right side surfaces of the main body 20, and the openable and closable front panel 7 forming a front surface of the main body 20.

The indoor heat exchanger 2, the indoor air-sending fan 3, the filter unit 4, the drain pan 10, and a not-illustrated electric component box are installed to the base 1.

The base 1 is installed to a wall surface of, for example, a living room forming the air-conditioned space.

The design panels 6 are removably attached to the left and right sides of the base 1. The design panels 6 attached to the base 1 are fixed to the base 1 with fastening members such as screws. The attachment of the design panels 6 to the base 1 will be described with FIGS. 12 and 13.

As illustrated in FIG. 4, the front panel 7 is removably attached to the design panels 6 to be openable and closable relative thereto.

As illustrated in FIG. 5, the main body 20 stores therein the indoor heat exchanger 2, the indoor air-sending fan 3, the filter unit 4, the drain pan 10, and the not-illustrated electric component box.

The indoor heat exchanger 2 is disposed on the front surface side of the base 1 to surround the indoor air-sending fan 3 to exchange heat between the refrigerant circulating through the refrigerant circuit 60 and indoor air supplied by the indoor air-sending fan 3.

The indoor air-sending fan 3 is disposed on the front surface side of the base 1 to be surrounded by the indoor heat exchanger 2, and is driven by a not-illustrated motor to generate a flow of air. A vertical air direction adjusting plate 8 is openably and closably installed below the indoor air-sending fan 3. When the vertical air direction adjusting plate 8 is opened, a portion of the main body 20 covered by the vertical air direction adjusting plate 8 is opened to form an air outlet 5.

The filter unit 4 is installed on the top surface side and the front surface side of the main body 20, and has a filter 4*a* removably attached thereto to catch dust contained in the air flowing from an air inlet 9. A portion of the filter unit 4 at the position of a top surface thereof is formed with grid-like openings forming the air inlet 9. FIG. 3 illustrates an example of the filter unit 4 in which a portion installed on the top surface side of the main body 20 and a portion installed on the front surface side of the main body 20 are integrated together. However, the portion installed on the top surface side and the portion installed on the front surface side may be separately installed to the main body 20.

The electric component box is installed on the front surface side of the base 1 to store electric components such as a control board. The control board is capable of communicating with a controller installed in the outdoor unit 50. The control board has a function of receiving an instruction from a user via a remote controller or another device. The instruction having received the control board is transmitted to the controller of the outdoor unit 50. The control board then controls the indoor air-sending fan 3 and other devices based on control signals transmitted from the controller of the outdoor unit 50. The control board may be formed of hardware such as a circuit device that implements functions of the control board, or may be formed of an arithmetic device such as a microcomputer or a CPU and software executed thereby.

When the main body 20 is assembled, an air passage 15 through which the air inlet 9 and the air outlet 5 communicate with each other is formed inside the main body 20.

Further, the drain pan 10 for receiving formed dew condensation water is installed below the indoor heat exchanger 2.

(Operation of Indoor Unit 100)

When the indoor air-sending fan 3 is driven, the indoor air is suctioned into the main body 20 from the air inlet 9. When the indoor air suctioned from the air inlet 9 passes through the indoor heat exchanger 2, the indoor air exchanges heat with the refrigerant flowing through the indoor heat exchanger 2. The indoor air is then cooled in the cooling operation or heated in the heating operation, and reaches the indoor air-sending fan 3. The air having passed the indoor air-sending fan 3 is blown out forward or downward into the air-conditioned space from the air outlet 5 provided with the vertical air direction adjusting plate 8.

The vertical air direction adjusting plate 8 extends along the longitudinal direction of the air outlet 5 (horizontal direction), and swings to change the vertical air direction of the air blown out from the air outlet 5 and open or close the air outlet 5.

(Base 1 and Design Panels 6)

Figure 6:
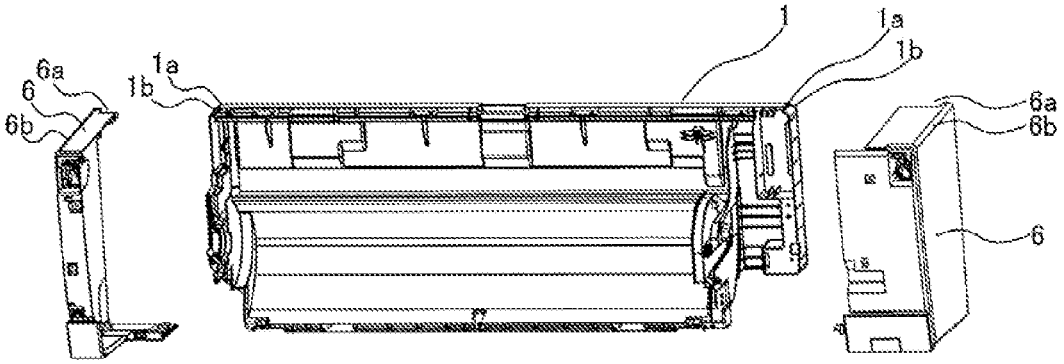
FIG. 6 is a schematic perspective view illustrating a state in which design panels are detached from a base of the indoor unit of the air-conditioning apparatus according to Embodiment of the present invention.
Figure 7:
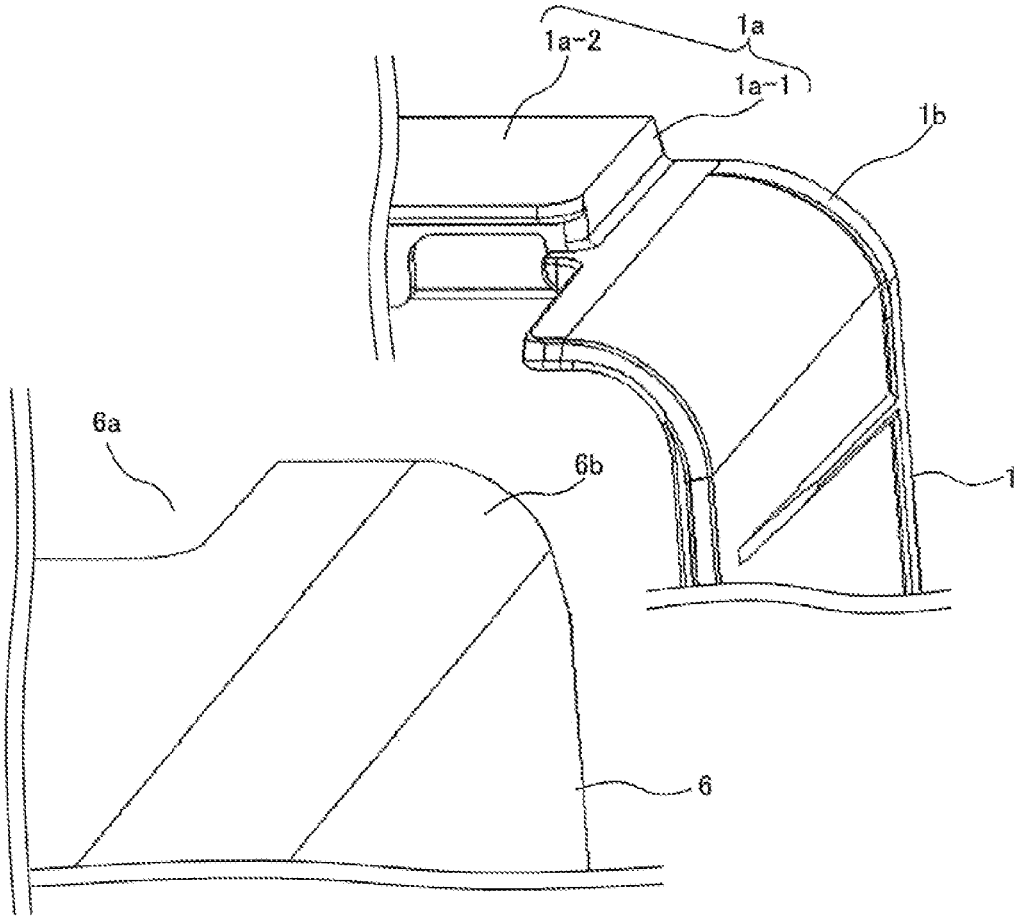
FIG. 7 is a schematic perspective view illustrating, on a larger scale, a state in which one of the design panels is detached from the base of the indoor unit of the air-conditioning apparatus according to Embodiment of the present invention.
Figure 8:
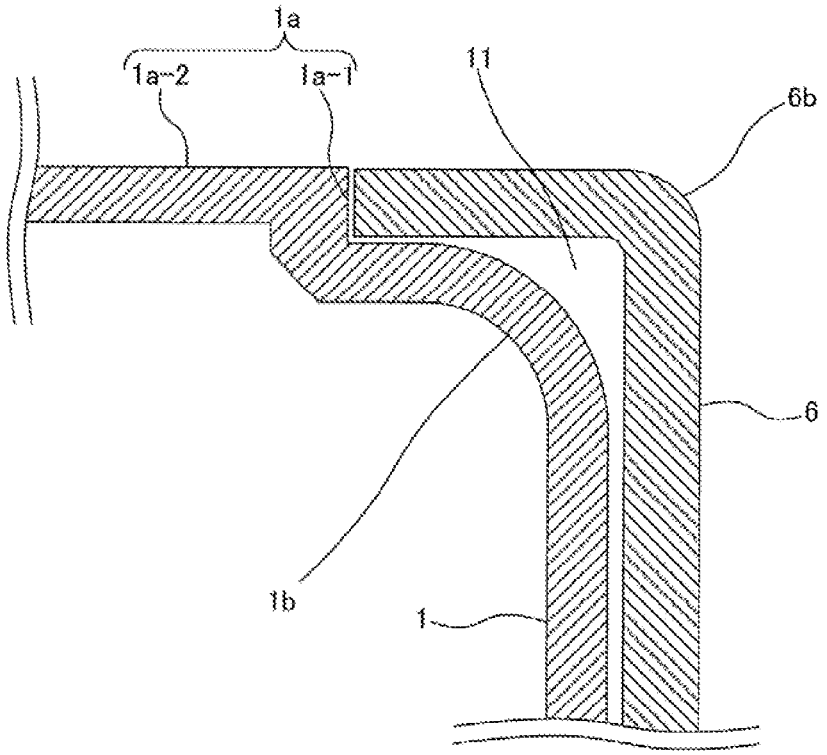
FIG. 8 is a schematic cross-sectional view illustrating, on a larger scale, a state in which the design panel is attached to the base of the indoor unit of the air-conditioning apparatus according to Embodiment of the present invention.

FIG. 6 is a schematic perspective view illustrating a state in which the design panels 6 are detached from the base 1 of the indoor unit 100. FIG. 7 is a schematic perspective view illustrating, on a larger scale, a state in which one of the design panels 6 is detached from the base 1 of the indoor unit 100. FIG. 8 is a schematic cross-sectional view illustrating, on a larger scale, a state in which the design panel 6 is attached to the base 1 of the indoor unit 100. The base 1 and the design panels 6 will be described in detail based on FIGS. 6 to 8.

FIG. 7 illustrates an enlarged view of upper-right portions of the base 1 and one of the design panels 6. Further, FIG. 8 schematically illustrates the configuration of a longitudinal cross section of the right side in the state in which the design panel 6 is attached to the base 1. Although the right side of the indoor unit 100 illustrated in the drawings will be described here as an example, the left side of the indoor unit 100 has a similar configuration. However, the configuration described below is not required to be provided on both the left side and the right side of the indoor unit 100, and it suffices if the configuration described below is provided on at least one of the left side and the right side.

As illustrated in FIG. 7, a part of a top surface side of the base 1 is formed with a step portion 1*a*. Specifically, the step portion 1*a* is formed with an end portion of a corner portion 1*b* of the base 1 on the top surface side projecting in the outer circumferential direction and extending in the width direction. The step portion 1*a* includes a wall portion 1*a*-1 projecting in the outer circumferential direction and a top surface portion 1*a*-2 continuously extending from the wall portion 1*a*-1 in the width direction to form a part of the top surface of the main body 20. As illustrated in FIG. 8, the height of the wall portion 1*a*-1 substantially corresponds to the thickness of the design panel 6.

Further, as illustrated in FIG. 7, the design panel 6 is formed with a cutout portion 6*a*. Specifically, the cutout portion 6*a* is formed by cutting a part of a top surface of the design panel 6 on the rear surface side thereof into a rectangular shape, leaving a corner portion 6*b* of the design panel 6. Therefore, the rear surface side of the top surface of the design panel 6 formed with the cutout portion 6*a* has a space formed by the cutout portion 6*a* and having an L-shape as viewed from above. The cutout portion 6*a* is formed into a shape corresponding to the shape of the top surface portion 1*a*-2 of the step portion 1*a*.

As illustrated in FIGS. 7 and 8, when the design panel 6 is attached to the base 1, the step portion 1*a* of the base 1 fits in the cutout portion 6*a* of the design panel 6. That is, the top surface portion 1*a*-2 of the step portion 1*a* of the base 1 is exposed through the cutout portion 6*a* of the design panel 6. Therefore, the top surface portion 1*a*-2 of the step portion 1*a* of the base 1 and a portion of the design panel 6 at the position of top surface thereof form the top surface of the main body 20. Further, the corner portion 6*b* of the design panel 6 covers the corner portion 1*b* of the base 1.

Further, since the height of the wall portion 1*a*-1 substantially corresponds to the thickness of the design panel 6, the top surface portion 1*a*-2 of the step portion 1*a* of the base 1 and the portion of the design panel 6 at the position of the top surface thereof make the top surface of the main body 20 flat. Further, the corner portion 6*b* of the design panel 6 covers the corner portion 1*b* of the base 1, therefore enabling a side surface of the main body 20 to be formed only with the design panel 6. Accordingly, the side surface of the main body 20 is formed of a single member, improving the design.

Further, the angle of the corner portion 1*b* of the base 1 (a first angle) and the angle of the corner portion 6*b* of the design panel 6 (a second angle) are different, as illustrated in FIG. 8. When the design panel 6 is attached to the base 1, therefore, a space 11 is formed between the outer circumference of the corner portion 1*b* of the base 1 and the inner circumference of the corner portion 6*b* of the design panel 6.

Herein, the angle of the corner portion 1*b* of the base 1 refers to the angle of the outer circumference of the corner portion 1*b* of the base 1, and the angle of the corner portion 6*b* of the design panel 6 refers to the angle of the inner circumference of the corner portion 6*b* of the design panel 6.

Further, as illustrated in FIG. 8, the corner portion 1*b* of the base 1 and the corner portion 6*b* of the design panel 6 are often curvedly formed. In such a case, the angle of the corner portion 1*b* of the base 1 and the angle of the corner portion 6*b* of the design panel 6 are paraphrased as the curvature of the corner portion 1*b* of the base 1 and the curvature of the corner portion 6*b* of the design panel 6, respectively.

It is therefore possible to change the shape of the design panel 6, with the angle (curvature) of the corner portion 6*b* of the design panel 6 having a minimum value equal to the angle (curvature) of the corner portion 1*b* of the base 1 and a maximum value enabling the formation of the allowable space 11. In other words, it is possible to freely change the design of the design panel 6 within this range.

Figure 9:
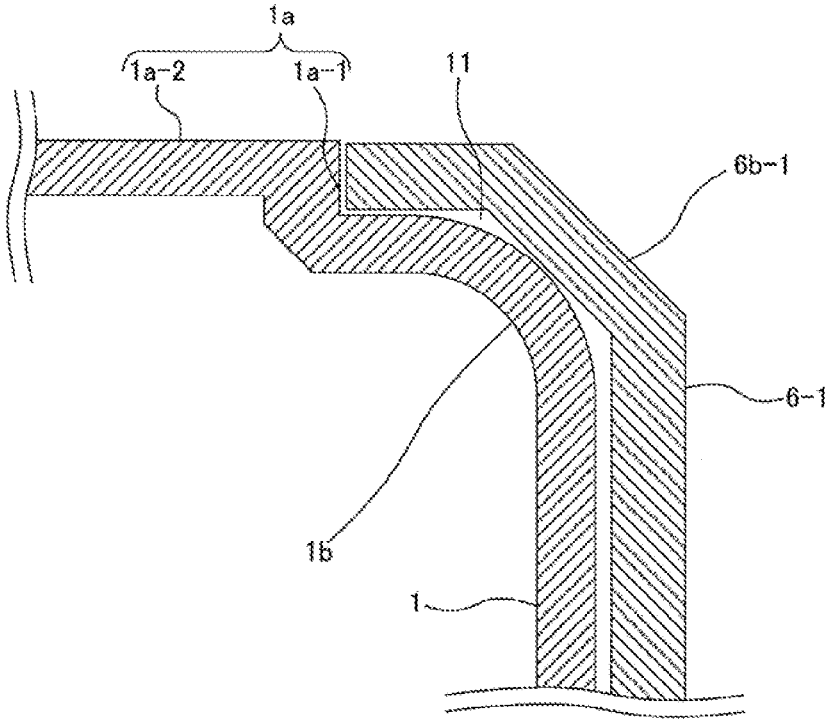
FIG. 9 is a cross-sectional view schematically illustrating one of variations of the design panel attached to the base of the indoor unit of the air-conditioning apparatus according to Embodiment of the present invention.
Figure 11:
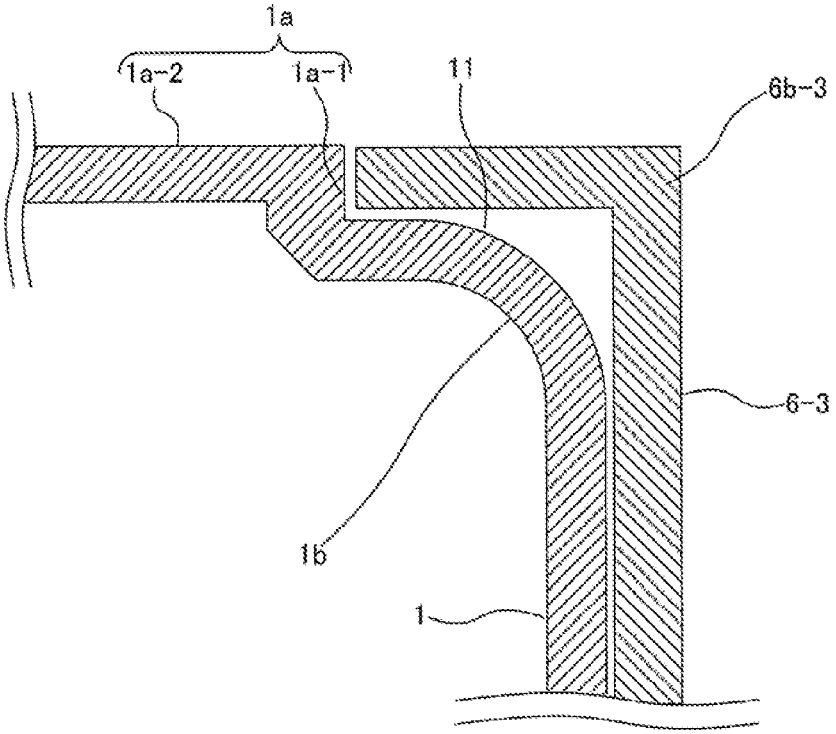
FIG. 11 is a cross-sectional view schematically illustrating still another one of the variations of the design panel attached to the base of the indoor unit of the air-conditioning apparatus according to Embodiment of the present invention.

As illustrated in FIGS. 9 and 11, the corner portion 1*b* and the corner portion 6*b* are not required to be curved similarly.

Although FIGS. 7 and 8 illustrate the top surface of the base 1, the step portion 1*a* and the cutout portion 6*a* may be provided on the lower surface of the base 1 or on both the top surface and the lower surface of the base 1. Further, although FIG. 6 illustrates an example of the step portion 1*a* and the cutout portion 6*a* formed near both the left side surface and the right side surface of the main body 20, it suffices if the step portion 1*a* and the cutout portion 6*a* are formed near at least one of the side surfaces. Further, although the step portion 1*a* having the height substantially corresponding to the thickness of the design panel 6 has been described as an example, the height of the step portion 1*a* is not required to strictly correspond to the thickness of the design panel 6.

Figure 10:
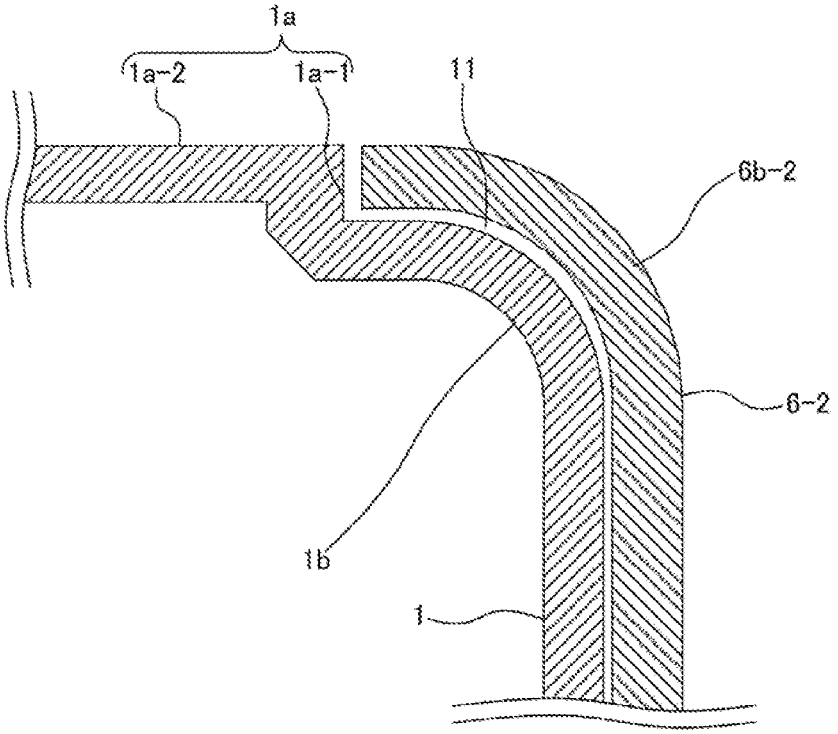
FIG. 10 is a cross-sectional view schematically illustrating another one of the variations of the design panel attached to the base of the indoor unit of the air-conditioning apparatus according to Embodiment of the present invention.

FIG. 9 is a cross-sectional view schematically illustrating one of variations of the design panel 6 attached to the base 1 of the indoor unit 100. FIG. 10 is a cross-sectional view schematically illustrating another one of the variations of the design panel 6 attached to the base 1 of the indoor unit 100. FIG. 11 is a cross-sectional view schematically illustrating still another one of the variations of the design panel 6 attached to the base 1 of the indoor unit 100. Variations of the design panel 6 will be described based on FIGS. 9 to 11. FIGS. 9 to 11 each schematically illustrate the configuration of a longitudinal cross section in the state in which the design panel 6 is attached to the base 1.

As illustrated in FIGS. 9 to 11, there is no change in the configuration of the base 1.

Meanwhile, the configuration of the design panel 6 is changed, as illustrated in FIGS. 9 to 11. The design panel 6 is illustrated as a design panel 6-1 in FIG. 9, as a design panel 6-2 in FIG. 10, and as a design panel 6-3 in FIG. 11 to illustrate changes in the configuration of the design panel 6. Further, respective corner portions thereof are illustrated as a corner portion 6*b*-1, a corner portion 6*b*-2, and a corner portion 6*b*-3. There is no change in the cutout portion 6*a* of the design panel 6.

For example, as illustrated in FIG. 9, the design panel 6-1 has the corner portion 6*b*-1 formed with a continuous flat surface. The design panel 6-1 with the thus-formed corner portion 6*b*-1 is also attachable to the base 1.

Further, as illustrated in FIG. 10, the design panel 6-2 has the corner portion 6*b*-2 formed with a curved surface having a substantially same curvature. The design panel 6-2 with the thus-formed corner portion 6*b*-2 is also attachable to the base 1.

Further, as illustrated in FIG. 11, in a cross-sectional view of the design panel 6-3, the angle of the design panel 6-3 is set to a substantially right angle to form the corner portion 6*b*-3. The design panel 6-3 with the thus-formed corner portion 6*b*-3 is also attachable to the base 1.

As illustrated in FIGS. 9 to 11, it is possible to freely change the design of the design panel 6 without changing the configuration of the base 1. It is therefore possible to select and attach the design panel 6 of a desired design to the indoor unit 100 from a plurality of design panels 6 having different shapes. That is, the indoor unit 100 allows desired selection from the plurality of design panels 6 having different shapes, and thus is adaptable to various series designs.

The plurality of design panels 6 having different shapes are different not only in shape but also in design aspects such as material, color, pattern, and texture, and it is possible to select as desired the design panel 6 from variations in the respective aspects. Further, there is no need to prepare in advance the plurality of design panels 6 having different shapes, and different variations of the design panel 6 may be designed as required each time.

Figure 12:
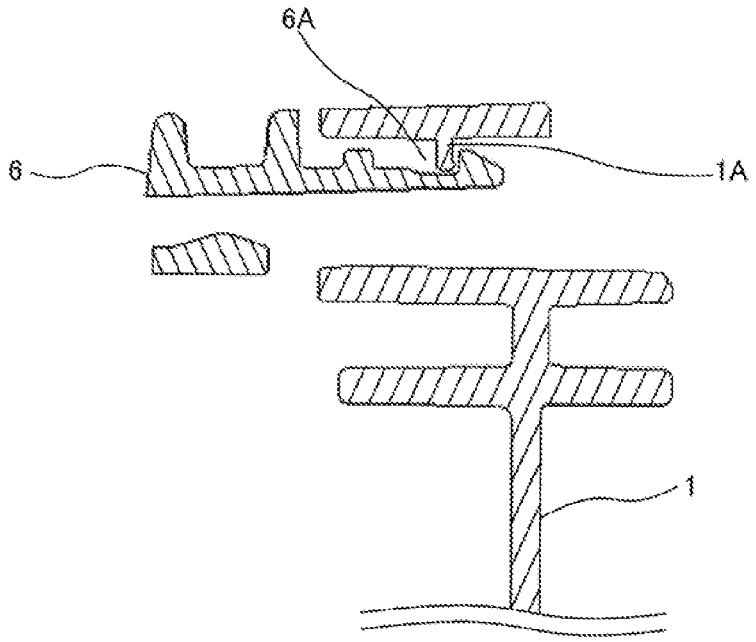
FIG. 12 is a cross-sectional view schematically illustrating an example of the state of attachment of top surface portions of the base and the design panel of the indoor unit of the air-conditioning apparatus according to Embodiment of the present invention.
Figure 13:
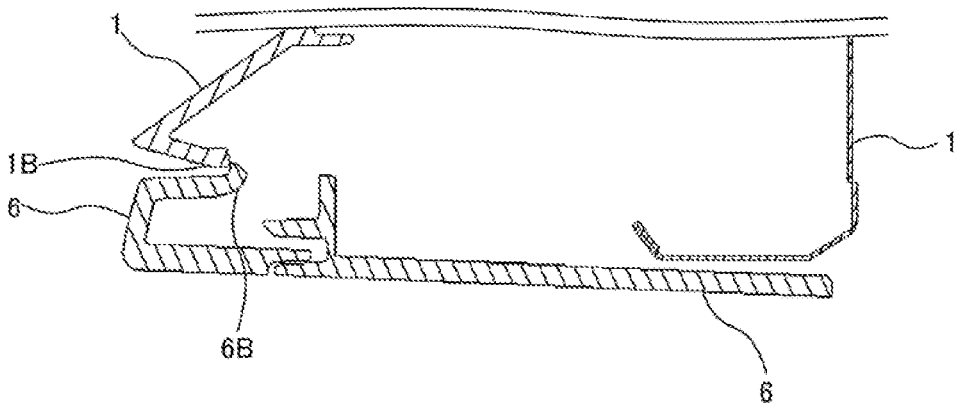
FIG. 13 is a cross-sectional view schematically illustrating an example of the state of attachment of lower surface portions of the base and the design panel of the indoor unit of the air-conditioning apparatus according to Embodiment of the present invention.

A description will now be given of an example of the procedure of attaching the design panel 6 to the base 1. FIG. 12 is a cross-sectional view schematically illustrating an example of the state of attachment of top surface portions of the base 1 and the design panel 6 of the indoor unit 100. FIG. 13 is a cross-sectional view schematically illustrating an example of the state of attachment of lower surface portions of the base 1 and the design panel 6 of the indoor unit 100. The attachment of the design panel 6 to the base 1 will be described based on FIGS. 12 and 13.

As illustrated in FIG. 12, a part of the top surface portion of the base 1 is formed with a projecting portion 1A projecting toward the inside of the main body 20. Further, as illustrated in FIG. 12, a part of the top surface portion of the design panel 6 is formed with a sack-like recessed portion 6A engageable with the projecting portion 1A.

As illustrated in FIG. 13, a part of the lower surface portion of the base 1 is formed with an engaging portion 1B projecting toward the rear surface of the base 1. Further, as illustrated in FIG. 13, a part of the lower surface portion of the design panel 6 is formed with a hook portion 6B engageable with the engaging portion 1B.

The projecting portion 1A provided to the base 1 first fits in the recessed portion 6A provided in the design panel 6, and thereby the design panel 6 engages with the base 1 in the top surface portion. When the design panel 6 engages with the base 1 in the top surface portion, the design panel 6 is swingable around engaging portions (the projecting portion 1A and the recessed portion 6A) as a fulcrum. Then, while the design panel 6 swingingly moves, the hook portion 6B of the design panel 6 engages with the engaging portion 1B of the base 1 in the lower surface portion. The design panel 6 is thus attached to the base 1. The design panel 6 and the base 1 are finally fixed with fastening members such as screws.

With FIGS. 12 and 13, a description has been given of an example in which the design panel 6 is attached to the base 1 with the projecting portion 1A and the recessed portion 6A and with the engaging portion 1B and the hook portion 6B. However, the method of attaching the design panel 6 to the base 1 is not particularly limited, and another structure for attachment may be employed.

As described above, the indoor unit 100 includes the base 1 forming the rear surface and a part of the top surface of the main body 20 and the design panel 6 removably attached to at least one of the left side and the right side of the base 1 to form a part of the top surface, a part of the lower surface, and a side surface of the main body 20. The base 1 includes the corner portion 1*b* connecting the top surface and a side surface of the base 1 and the lower surface and the side surface of the base 1 and the step portion 1*a* formed on at least one of the top surface and the lower surface of the base. The design panel 6 includes the corner portion 6*b* connecting the top surface and a side surface of the design panel 6 and the lower surface and the side surface of the design panel 6 and the cutout portion 6*a* formed in at least one of the top surface and the lower surface of the design panel 6. When the design panel 6 is attached to the base 1, the step portion 1*a* has the top surface portion 1*a*-2 exposed through the cutout portion 6*a*, with the top surface portion 1*a*-2 and the design panel 6 forming the top surface of the main body 20, and the design panel 6 forms the side surface of the main body 20, with the corner portion 6*b* covering the corner portion 1*b*. The design panel 6 is formed to be selected from the plurality of design panels 6 having different shapes and be attachable to the base 1.

According to the indoor unit 100, therefore, the side surface of the main body 20 is formed of the single design panel 6, therefore improving the design. In addition, the indoor unit 100 is easily adaptable to various series designs different in the shape of the design panel 6, without changing the configuration of the base 1.

According to the indoor unit 100, the corner portion 6*b* is changeable with the angle or curvature thereof ranging from the minimum value equal to the angle or curvature of the corner portion 1*b* to the value enabling the formation of the allowable space 11 between the outer circumference of the corner portion 1*b* and the inner circumference of the corner portion 6*b*.

It is therefore possible to prepare various variations of the design panel 6, enabling the design panel 6 of a variation selected as desired from those variations to be easily attached to the base 1.

According to the indoor unit 100, when the design panel 6 is attached to the base 1, the top surface of the main body 20 formed by the top surface portion 1*a*-2 and the design panel 6 becomes flat. Therefore, the design of the top surface of the main body 20 is also improved.

The air-conditioning apparatus A includes the indoor unit 100 and the outdoor unit 50 connected to the indoor unit 100, and thus has all effects of the indoor unit 100.

The present invention has been described above with an example of the indoor unit 100 installed to a wall surface of a living room. However, the present invention is not limited thereto, and is also applicable to an indoor unit having another structure (such as an indoor unit placed on a floor, for example).

REFERENCE SIGNS LIST

1 base 1A projecting portion 1B engaging portion 1*a* step portion 1*a*-1 wall portion 1*a*-2 top surface portion 1*b* corner portion (first corner portion) 2 indoor heat exchanger 3 indoor air-sending fan 4 filter unit 4*a* filter 5 air outlet 6 design panel 6-1 design panel 6-2 design panel 6-3 design panel 6A recessed portion 6B hook portion 6*a* cutout portion 6*b* corner portion (second corner portion) 6*b*-1 corner portion (second corner portion) 6*b*-2 corner portion (second corner portion) 6*b*-3 corner portion (second corner portion) 7 front panel 8 vertical air direction adjusting plate 9 air inlet 10 drain pan 11 space 15 air passage 20 main body 50 outdoor unit 51 compressor 52 four-way switching valve 53 outdoor heat exchanger 54 expansion valve 55 outdoor air-sending device 56 gas-side communication pipe 57 liquid-side communication pipe 60 refrigerant circuit 100 indoor unit A air-conditioning apparatus

The invention claimed is:

1. An indoor unit of an air-conditioning apparatus, the indoor unit comprising:

a base forming a rear surface and a part of a top surface of a main body; and a design panel removably attached to at least one of a left side and a right side of the base to form a part of the top surface, and a side surface of the main body, wherein the base includes a first corner portion connecting a top surface and a side surface of the base, and a step portion formed on the top surface of the base, wherein the design panel includes a second corner portion connecting a top surface and a side surface of the design panel, and a cutout portion formed in the top surface of the design panel, and wherein when the design panel is attached to the base, the step portion has a top surface portion exposed through the cutout portion, with the top surface portion and the design panel forming the top surface of the main body, and the design panel forms the side surface of the main body, with the second corner portion covering the first corner portion, and wherein the step portion includes a wall portion projecting outward of an end portion of the first corner portion, and the top surface portion continuously extending from the wall portion to a center part in a left-and-right direction of the base, and wherein when the design panel is attached to the base, the top surface portion and the design panel form a flat top surface of the main body.

2. The indoor unit of the air-conditioning apparatus of claim 1, wherein the second corner portion is changeable with an angle or curvature of the second corner portion ranging from a minimum value equal to an angle or curvature of the first corner portion to a value enabling formation of an allowable space between an outer circumference of the first corner portion and an inner circumference of the second corner portion.

3. The indoor unit of claim 1, wherein the design panel is formed to be selectable from a plurality of design panels having different shapes.

4. An air-conditioning apparatus comprising:

the indoor unit of claim 1; and an outdoor unit connected to the indoor unit.

* * * * *